US008528376B2

(12) United States Patent
Li et al.

(10) Patent No.: US 8,528,376 B2
(45) Date of Patent: Sep. 10, 2013

(54) MOLD SET FOR MANUFACTURING CASE AND THE METHOD THEREOF

(75) Inventors: Ming-Fu Li, Kaohsiung (TW); Sheng-Chi Tsai, Kaohsiung (TW); Ping-Kuo Cheng, Kaohsiung (TW); Tai-Chang Chen, Kaohsiung (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 358 days.

(21) Appl. No.: 12/911,259

(22) Filed: Oct. 25, 2010

(65) Prior Publication Data

US 2011/0155341 A1 Jun. 30, 2011

(30) Foreign Application Priority Data

Dec. 31, 2009 (TW) ..... 98146629 A

(51) Int. Cl.
*B21D 39/08* (2006.01)

(52) U.S. Cl.
USPC ..... 72/57; 72/58; 72/60; 29/421.1

(58) Field of Classification Search
USPC ..... 72/57, 60, 347, 370, 398, 399, 58, 72/59, 370.22, 381, 382, 383, 384, 394, 396, 72/307, 389.1, 389.3, 709, 55; 29/421.1, 29/889.72
See application file for complete search history.

(56) References Cited

U.S. PATENT DOCUMENTS

| | | | | |
|---|---|---|---|---|
| 4,265,102 | A * | 5/1981 | Shimakata et al. | 72/58 |
| 5,022,135 | A * | 6/1991 | Miller et al. | 29/421.1 |
| 5,449,109 | A * | 9/1995 | Chuang et al. | 228/157 |
| 6,032,501 | A * | 3/2000 | Bihrer | 72/58 |
| 6,401,509 | B1 * | 6/2002 | Amborn | 72/62 |
| 6,952,941 | B2 * | 10/2005 | Friedman et al. | 72/57 |
| 6,966,209 | B1 * | 11/2005 | Schulze | 72/61 |
| 7,650,773 | B2 * | 1/2010 | Shikano et al. | 72/382 |
| 7,669,450 | B2 * | 3/2010 | Friedman et al. | 72/60 |
| 2002/0166359 | A1 * | 11/2002 | Moss | 72/381 |
| 2003/0172512 | A1 * | 9/2003 | Suarez | 29/421.1 |

FOREIGN PATENT DOCUMENTS

| | | | |
|---|---|---|---|
| CN | 2683274 | Y | 3/2005 |
| CN | 101596565 | A | 12/2009 |
| KR | 20070059593 | A | 6/2007 |
| TW | 311209 | A | 7/1997 |
| TW | 200711761 | A | 4/2007 |
| TW | I308300 | A | 4/2009 |
| WO | 2007024442 | A3 | 4/2007 |

* cited by examiner

*Primary Examiner* — Dana Ross
*Assistant Examiner* — Homer Boyer
(74) *Attorney, Agent, or Firm* — Volpe and Koenig, P.C.

(57) ABSTRACT

A mold set for manufacturing a case is provided. The mold set comprises an upper mold having a fluid channel; a lower mold facing the upper mold; and a drawing mold disposed between the upper mold and the lower mold, wherein the mold set has a case forming space formed among the upper mold, the lower mold and the drawing mold, and the mold set has a sharp-edge forming space communicating with the case forming space, and formed between the drawing mold and the lower mold.

13 Claims, 7 Drawing Sheets

MOLD SET FOR MANUFACTURING CASE AND THE METHOD THEREOF

FIELD OF THE INVENTION

The present invention relates to a mold set for manufacturing a case and the method thereof, and more particularly to a mold set for manufacturing a metal case and the method thereof.

BACKGROUND OF THE INVENTION

A case having concave chamfers, especially applied in 3C electronic products, sometimes has an extremely shallow (about 10 mm) concave depth, which is unfavorable for the conventional metal stamping mold design. The concave chamfer will be stuck, difficult to combine and stamped with an extremely shallow concave when releasing mold. Therefore the concave chamfer presently is made of plastic material, and is made by injection molding or vacuum forming. Compared with the metal case, although the plastic case has better elasticity of forming plasticity, however there are defects of bad radiating, insufficient rigidity and heavy plastic sense. Additionally, another conventional technique to manufacture concave chamfer metal case uses a male mold manufactured by a rubber material and uses the elasticity of rubber to conveniently release mold. However, after used for a period of time, the rubber material will lose its elasticity gradually to be embrittled. In other words, the life of the rubber male mold is short. Further, controlling the forming quality is not easy due to the deformation of rubber itself, so the rubber male mold still has a lot of defects. Besides, the concave chamfer structure can also be manufactured by lost-wax casting. However, for the cases of consuming electronic products necessary for mass production, the lost-wax casting no doubt is the largest obstruction for output promotion or raising the producing speed, so it is not practicable.

In order to overcome the drawbacks in the prior art, a mold set for manufacturing a case and the method thereof are provided. The particular design in the present invention not only has better heat-dissipating effect compared with the conventional plastic case, but also increases the rigidity of the case due to higher strength of metal. In addition, as the metal has higher specific weight than the plastics, it has more weight than the plastics, and due to low specific heat, the slightly cool sense makes a user unable to put it down.

SUMMARY OF THE INVENTION

An object of the present invention is to provide a mold set which can manufacture the concave chamfer metal case and the method thereof. Through the manufacturing method and the mold set of the present invention, a metal case having concave chamfers can be manufactured easily and fast, which enables a lot of consuming electronic products to use the metal case with concave chamfers by low price. This enhances the quality of the product, thereby increases the sales volume.

Another object of the present invention is to form a sharp edge on the metal case with concave chamfer to make the appearance and shape of a product applying such metal case have a sharper sense. Furthermore, the sharp edge let a user have a sharper and clear-cut touching sense, rather than a smooth and indistinct curve.

In accordance with one aspect of the present invention, a mold set for manufacturing a case is provided. The mold set comprises an upper mold having a fluid channel; a lower mold facing the upper mold; and a drawing mold disposed between the upper mold and the lower mold, wherein the mold set has a case forming space formed among the upper mold, the lower mold and the drawing mold, and the mold set has a sharp-edge forming space communicating with the case forming space, and formed between the drawing mold and the lower mold.

Preferably, the lower mold further comprises a first lower mold disposed under the case forming space; and a second lower mold containing the first lower mold, and configured as a guiding structure, wherein when the first lower mold makes a movement, the second lower mold guides the movement toward the sharp-edge forming space.

Preferably, the drawing mold further has at least one concave chamfer forming surface, and the mold set has an angle formed between the at least one concave chamfer forming surface and the lower mold, configured in the sharp-edge forming space, and being an acute angle.

Preferably, the drawing mold further has a working frame located in the position where the drawing mold contacts the surroundings of the case forming space.

Preferably, the working frame further comprises an upper frame under the upper mold; and a lower frame under the upper frame and above the lower mold, wherein the upper frame has a circumference shorter than that of the lower frame.

Preferably, the working frame has a corner, and the drawing mold has a parting line extending outward from the corner of the working frame.

Preferably, the drawing mold is divided into a left submold and a right submold by the parting line, and the drawing mold has one of actions to be joined and split by moving at least one of the right submold and the left submold.

Preferably, the left submold is fixed to the lower mold, and when the right submold moves relatively to the left submold, the drawing mold is made to have one of actions to be joined and split.

In accordance with another aspect of the present invention, a method for manufacturing a case is provided. The method comprises steps of providing a lower mold including a first lower mold and a second lower mold containing the first lower mold; providing a drawing mold on the lower mold; operating the drawing mold to form a case forming space between the drawing mold and the lower mold; placing a blank on the drawing mold; providing an upper mold; joining the upper mold and the drawing mold to allow the blank to be disposed between the upper mold and the drawing mold; deforming the blank into the case forming space; and moving the first lower mold upward to form a sharp edge on the case.

Preferably, the step of deforming the blank into the case forming space is performed by providing a working fluid flowing through the upper mold to the blank.

Preferably, the method further comprises a step of forming a sharp-edge forming space between the lower mold and the drawing mold, wherein the sharp edge is formed in the sharp-edge forming space.

Preferably, the working fluid is a liquid.

Preferably, the working fluid is a gas.

Preferably, the method further comprises a step of heating the blank.

In accordance with a further aspect of the present invention, an edge mold set for forming a sharp edge on a case is provided. The edge mold set comprises a lower forming mold placing thereon the case; an upper forming mold disposed above the lower forming mold, wherein the case is disposed between the lower forming mold and the upper forming mold; and a positioning mold fixing the case, wherein the edge mold set has a sharp-edge forming space formed between the lower forming mold and the upper forming mold.

Preferably, the case is a concave-chamfered case.

Preferably, the edge mold set is further combined with a chamfer mold set for forming a concave chamfer, wherein the chamfer mold set includes an upper mold having a fluid channel; a lower mold facing the upper mold; and a drawing mold disposed between the upper mold and the lower mold, wherein the chamfer mold set has a case forming space formed among the upper mold, the lower mold and the drawing mold, and a blank of the case is to be disposed between the upper mold and the drawing mold.

Preferably, the drawing mold further has at least one concave chamfer forming surface, and the chamfer mold set has an angle formed between the at least one concave chamfer forming surface and the lower mold, configured in the sharp-edge forming space, and being an acute angle.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
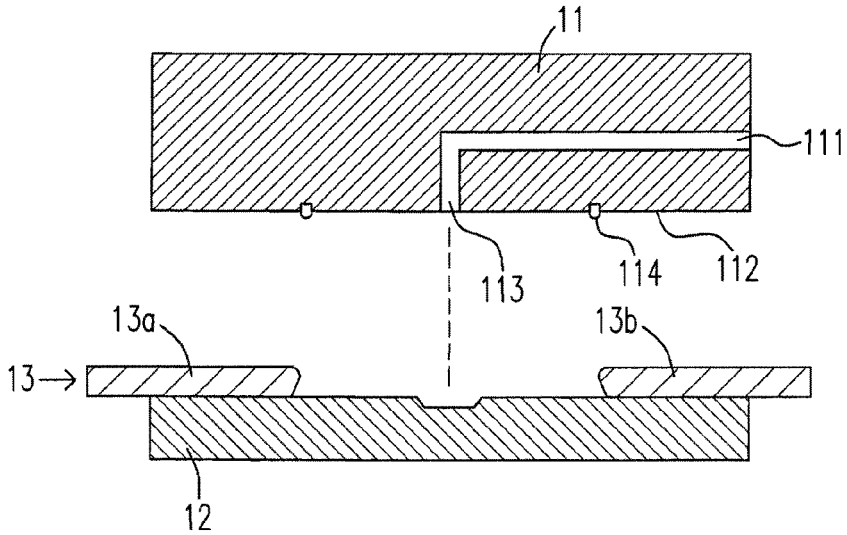
FIGS. 1-7 show the edge forming steps and the mold set according to a preferred embodiment of the present invention.
Figure 2:
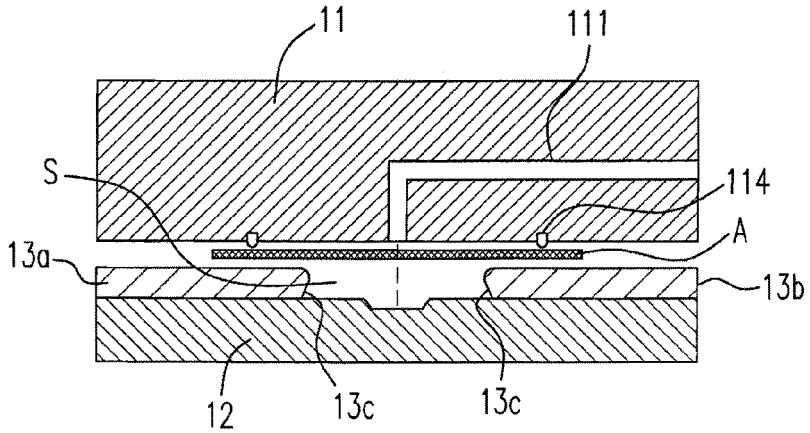
Figure 3:
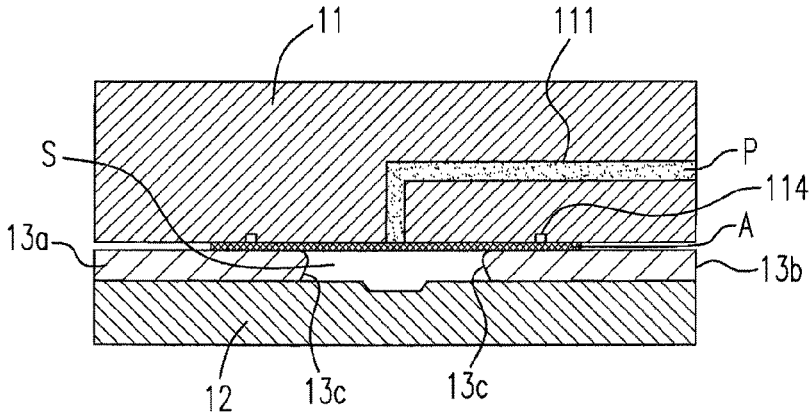
Figure 4:
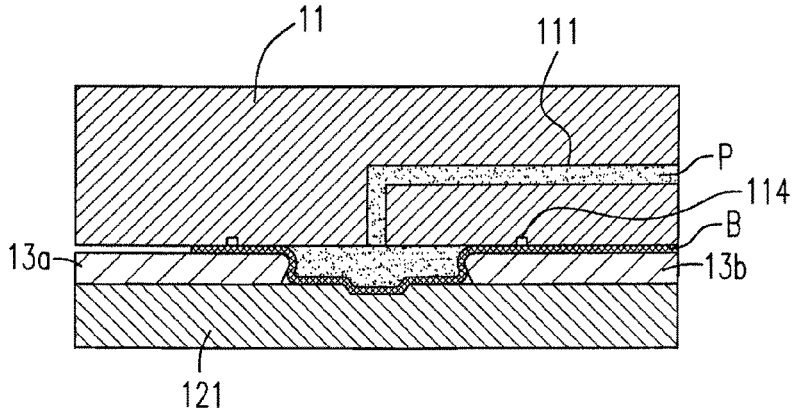

Please refer to FIGS. 1-7, which show the edge forming steps and the mold set according to a preferred embodiment of the present invention. In these figures, a mold set for manufacturing a metal case, more particularly for manufacturing a metal case having at least one concave chamfer on which a sharp edge is formed, is disclosed. Please refer to FIGS. 1, 2 and 3, wherein a mold set for forming two concave chamfers is provided. The mold set comprises an upper mold 11 having a fluid channel 111, and a lower mold 12 facing the upper mold 11. Besides, for forming two concave chamfers and unloading the case with these concave chamfers easily, a drawing mold 13 is further disposed between the upper mold 11 and the lower mold 12, which is bilateral. The drawing mold 13 is further divided into a left submold 13*a* and a right submold 13*b*. When the left submold 13*a* and the right submold 13*b* are joined, and the upper mold 11 and the lower mold 12 are joined, a case forming space S is formed among the upper mold 11, the lower mold 12 and the drawing mold 13. There are different ways of joining and splitting the drawing mold 13 according to forming precision, developmental cost of the mold, local space, etc. For instance, each of the left submold 13*a* and the right submold 13*b* is driven by different driving devices (not shown); the left submold 13*a* and the right submold 13*b* are connected by a gearing (not shown) and driven by a driving device (not shown); one of the left submold 13*a* and the right submold 13*b* is fixed on the lower mold 12, and the other is driven by a driving device. In FIG. 2, the left submold 13*a* and the right submold 13*b* beside the case forming space S respectively have a concave chamfer forming surface 13*c*, wherein an acute angle is formed between the concave chamfer forming surface 13*c* and the lower mold 12.

Preferably, the upper mold 11 further comprises a sealing component 114, which is opposite to the drawing mold 13, is disposed on a working surface 112 and surrounds circumferences of the case forming space S. The sealing component 114 is made of flexible material, such as robber or silica gel.

Figure 5:
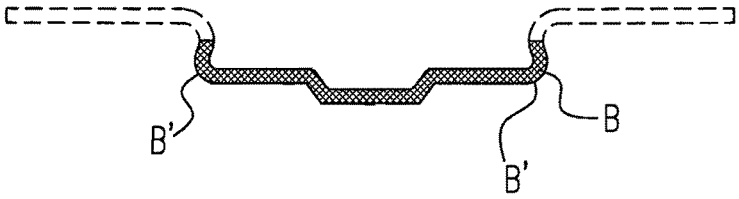

Please refer to FIGS. 1-4. When a metal case with concave chamfers is to be manufactured, a blank A is disposed between a working surface 112 of the upper mold 11 and the drawing mold 13, while the case forming space S is formed under the blank A, and between the drawing mold 13 and the lower mold 12. At this time, the pressure forming can be performed. A working fluid P, usually a high pressure liquid, is provided; hence the pressure forming is also liquid pressure forming. The working fluid P flows into a fluid channel 111 to exert force upon the blank A and flows out from an exit 113. As the case forming space S under the blank A is an empty space, which can not supports the blank A, when the working fluid P acts on the blank A, the blank A is deformed due to the force from the working fluid P. Please refer to FIG. 4. The deformed blank A would enter the case forming space S to be adhered to the inside thereof. When the upper mold 11 and the lower mold 12 are joined which the blank A is disposed therebetween, the sealing component 114 would be deformed due to the force from the upper mold 11 and be adhered to the blank A completely. When the working fluid P is flowed from the exit 113 toward the blank A and exerts force thereupon, the deformed sealing component 114, which is adhered to the blank A acts a sealing function, make the working fluid P would not leak out from the space between the blank A and the working surface 112, and quickly establish a pressure of forming the blank A. If the working fluid P is a gas, the blank A and the mold set would need to be heated. Finally, the working fluid P is drained away, the upper mold 11 is separated from the drawing mold 13, the left submold 13*a* and the right submold 13*b* of the drawing mold 13 are removed from each other in left and right directions respectively, and a case B can be taken out. The dotted lines in FIG. 5 represent waste materials. After the waste materials are removed, a complete case B is obtained. The left and right sides of the case B respectively show a concave chamfer structure B' of the present invention, which is formed by the case forming space S having a narrow top and a wide bottom. In other words, the case forming space S tapers off from the lower mold 12 to the upper mold 11, which is achieved by the concave chamfer forming surfaces 13*c*. If the tapered structures at two sides of the case forming space S are not formed by utilizing the drawing mold 13, the case with concave chamfers will be unable to release.

Figure 6:
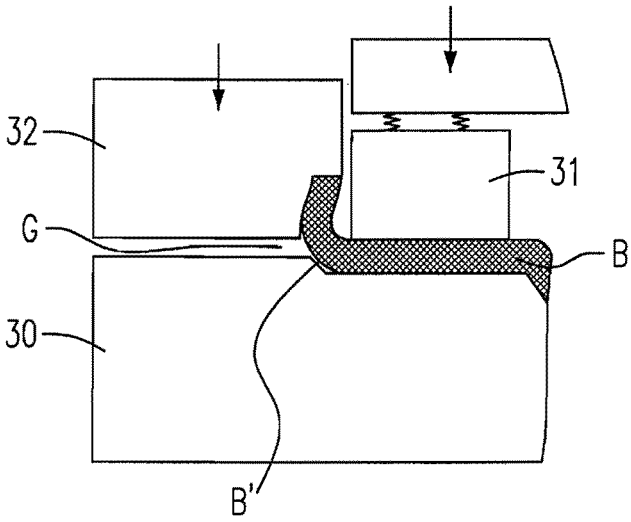
Figure 7:
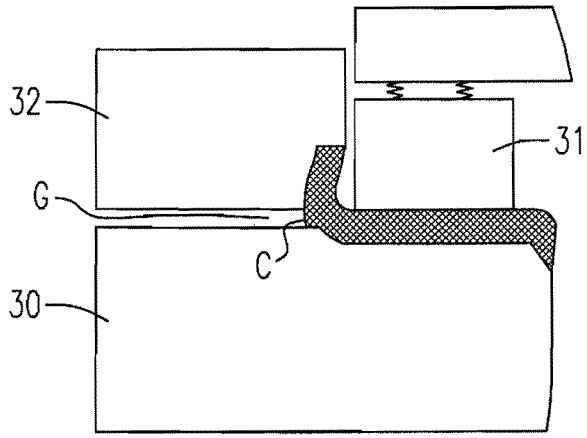

Please refer to FIGS. 6-7, which show the edge forming mold set and the edge forming steps according to a preferred embodiment of the present invention. An edge forming mold set comprises a lower forming mold 30, an upper forming mold 32 and a positioning mold 31. The lower forming mold 30 is used for placing the case B thereon and usually has a function of positioning the case B. The upper forming mold 32 is disposed above the lower forming mold 30, wherein the case B is disposed between the lower forming mold 30 and the upper forming mold 32. The lower forming mold 30 is attached to the lower surface of the concave chamfer structure B', and the upper forming mold 32 is attached to the upper surface of the concave chamfer structure B'. In addition, the positioning mold 31 (or a blank holder) is used to press the case B to make it fixed firmly on the lower forming mold 30. When the positioning mold 31 and the lower forming mold 30 fix the case B together, and the upper forming mold 32 and the lower forming mold 30 also press the case B from both sides, a sharp-edge forming space G is formed between the upper forming mold 32 and the lower forming mold 30. In other words, there is a distance between the two forming molds 32, 30, which is a beforehand space for the two forming molds 32, 30 to approach each other.

Please refer to FIGS. 6-7. After the upper forming mold 32, the lower forming mold 30 and the positioning mold 31 fix the case B and are in their respective positions, the upper forming mold 32 and the lower forming mold 30 approach each other, thereby compressing the case B. Therefore, the concave chamfer structure of the case B is further compressed to be deformed and become flatter than the original concave chamfer structure B'. Namely an arc shape of the outer edge of the concave chamfer shown in FIG. 5 would become sharper by mutual compression of the upper forming mold 32 and the lower forming mold 30. Therefore, an arc edge of the metal case can be changed to a sharp edge C. Surely the sharp edge C of the metal case can be produced in different positions via different positions of the sharp-edge forming space G.

Figure 8:
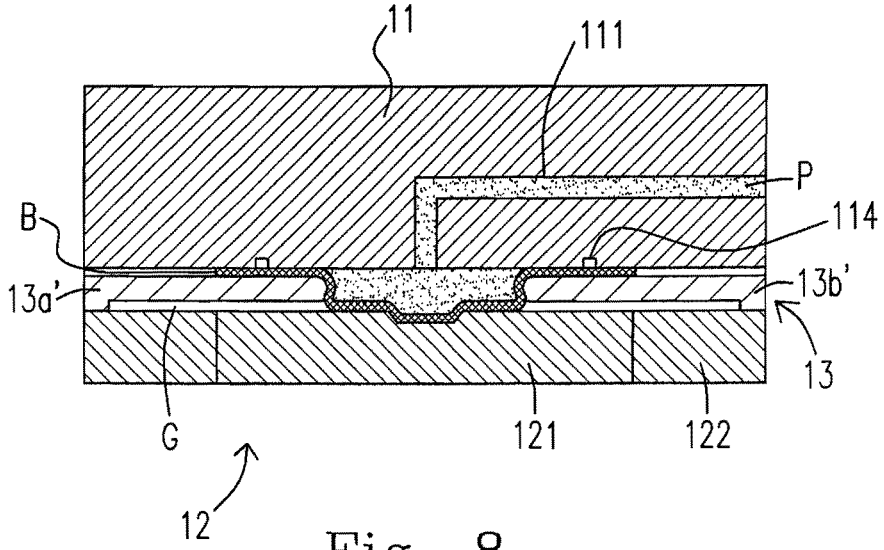
FIGS. 8-9 show the edge forming steps and the mold set according to another preferred embodiment of the present invention.
Figure 9:
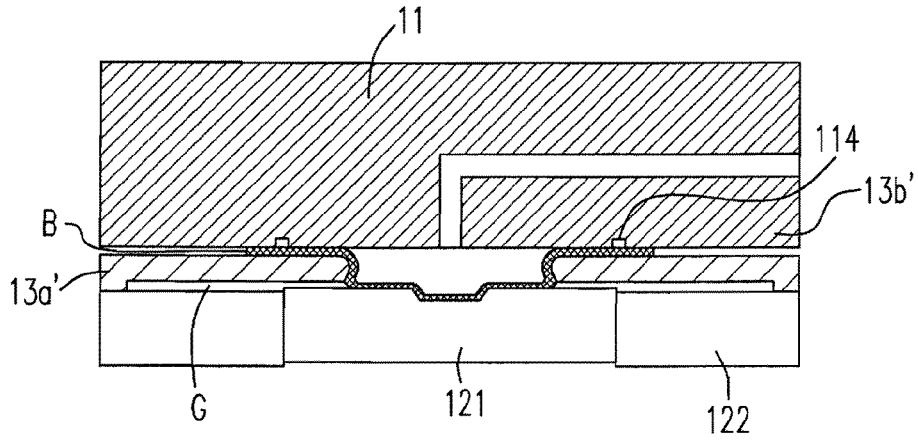

Please refer to FIGS. 8-9, which show the edge forming steps and the mold set according to another preferred embodiment of the present invention. A mold set for manufacturing a metal case, particularly for manufacturing a metal case with at least one concave chamfer having a sharp edge thereon, is disclosed. Please refer to FIG. 8. The mold set includes an upper mold 11 having a fluid channel 111, and a lower mold 12 facing the upper mold 11. Besides, for forming two concave chamfers and unloading the case with these concave chamfers easily, a drawing mold 13 is further disposed between the upper mold 11 and the lower mold 12, which is bilateral. The drawing mold 13 is further divided into a left gap-mold 13*a*' and a right gap-mold 13*b*'. When the left gap-mold 13*a*' and the right gap-mold 13*b*' are joined, and the upper mold 11 and the lower mold 12 are joined, a case forming space S is formed among the upper mold 11, the lower mold 12 and the drawing mold 13 (please refer to FIG. 3).

Preferably, the upper mold 11 further comprises a sealing component 114, which is opposite to the drawing mold 13, is disposed on a working surface 112 and surrounds circumferences of the case forming space S. The sealing component 114 is made of flexible material, such as robber or silica gel. Similarly, when the upper mold 11 fixes a case B, the sealing component 114 can be adhered to the case B completely, act a sealing function, make the working fluid P would not leak out from the space between the case B and the upper mold 11, and quickly establish a pressure of forming the blank A. Please refer to FIG. 8, which differs from FIG. 3 in that there is further a sharp-edge forming space G communicating with the case forming space S between the drawing mold 13 and the lower mold 12. The sharp-edge forming space G in FIG. 8 is achieved by reducing the thicknesses of the left gap-mold 13*a*' and the right gap-mold 13*b*'. In other words, there are gaps between the bilateral sides of the drawing mold 13 and the lower mold 12, so that the sharp-edge forming space G is formed between the drawing mold 13 and the lower mold 12. In addition, FIG. 8 further discloses that the lower mold 12 is further divided into a first lower mold 121 and a second lower mold 122, wherein the first lower mold 121 is disposed inside the second lower mold 122 so that the second lower mold 122 guides the movement of the first lower mold 121 toward the sharp-edge forming space G Please refer to FIG. 9. When the first lower mold 121 compresses the case B upward, it moves toward the drawing mold 13 due to the existence of the sharp-edge forming space G Through the compression between the first lower mold 121 and the drawing mold 13, the concave chamfer of the case B is compressed, thereby forming a sharp edge.

Figure 10:
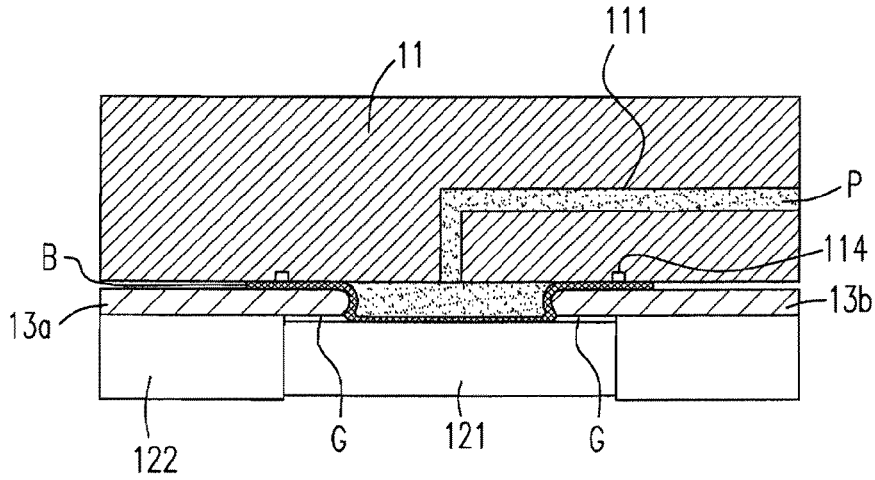
FIG. 10 shows the edge mold set according to a preferred embodiment of the present invention.

Please refer to FIG. 10, which shows the edge mold set according to another preferred embodiment of the present invention. FIG. 10 differs from FIGS. 8-9 in that the drawing mold 13 disclosed in FIG. 10 is the same as that disclosed in FIG. 1, which has a left submold 13*a* and a right submold 13*b*, but the lower mold 12 is the same as that disclosed in FIGS. 8-9, which is divided into a first lower mold 121 and a second lower mold 122. The upper mold 11 also has a fluid channel 111. When a blank A (please refer to FIG. 3) is disposed between the drawing mold 13 and the upper mold 11, and the second lower mold 122 is attached to the drawing mold 13, a case forming space S is formed among the first lower mold 121, the drawing mold 13 and the upper mold 11. FIG. 10 differs from FIG. 8 in that the thickness of the first lower mold 121 is thinner than that of the second lower mold 122 so that the first lower mold 121 is not attached to the drawing mold 13, but keeps a specific distance therefrom to form a sharp-edge forming space G communicating with the case forming space S. Similarly, the left submold 13*a* and the right submold 13*b* can be joined and split by moving respectively or simultaneously. In other applications, one of the left submold 13*a* and the right submold 13*b* can be chosen to be fixed on the second lower mold 122, and the other can move relatively to the fixed one to join and split the drawing mold 13. Besides, the upper mold 11 in FIG. 10 also has a sealing component 114. Regarding the detail description of the sealing component 114, please refer to the above mentioned contents, and it is not described more than what is needed here. When the case B (please refer to FIG. 3) is to be formed, the working fluid P is poured into the case forming space S. The blank A is deformed toward the case forming space S to become the case B shown in FIG. 10 due to the pressure of the fluid. At this time, a concave chamfer structure of the case B is formed near the sharp-edge forming space G. Then, the first lower mold 121 is moved toward the case B. Since the sharp-edge forming space G provides a gap for the first lower mold 121 to move, the first lower mold 121 and the drawing mold 13 can compress the concave chamfer structure of the case B from both sides in a pinch-like way. Therefore, the smooth shape of the concave chamfer structure would be sharper after compressed.

Figure 11:
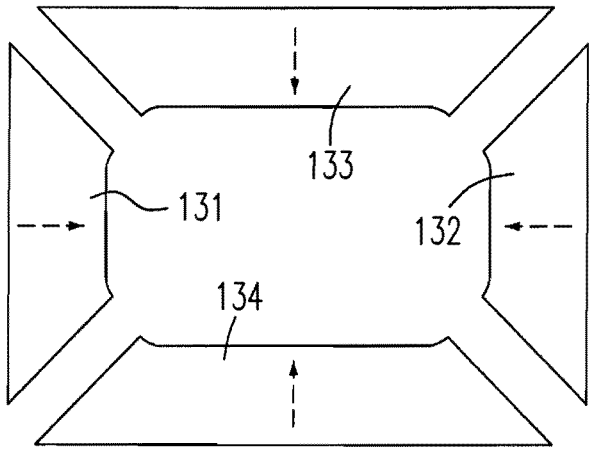
FIGS. 11-12 show the drawing mold according to a preferred embodiment of the present invention.
Figure 12:
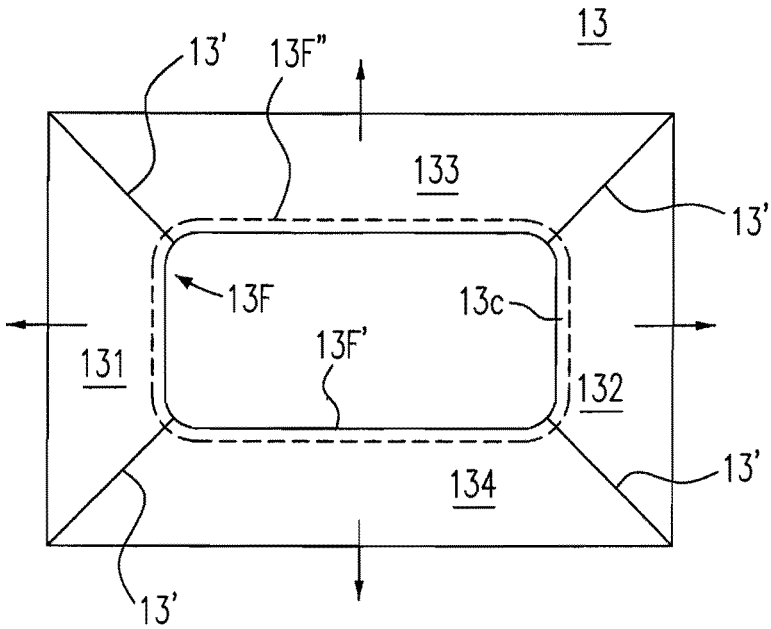

Please refer to FIGS. 11-12, which show the drawing mold according to a preferred embodiment of the present invention. The drawing mold 13 is divided into a first submold 131, a second submold 132, a third submold 133 and a fourth submold 134. The joined state of the drawing mold 13 is shown in FIG. 12, and the split state of the drawing mold 13 is shown in FIG. 11, wherein a working frame 13F is formed in the drawing mold 13. Please refer to FIGS. 3 and 10. The working frame 13F is located in the position where the drawing mold 13 contacts the surroundings of the case forming space S. For unloading the case with concave chamfers conveniently, the division of the drawing mold 13 shown in FIG. 12 is achieved by forming the parting lines 13' extending outward from each corner of the working frame 13F. Besides, the working frame 13F further includes an upper frame 13F' and a lower frame 13F". Since FIG. 12 is a top view of the drawing mold 13, the lower frame 13F" is represented by dotted lines, and there are the concave chamfer forming surfaces 13*c* between the upper frame 13F' and the lower frame 13F". The upper frame 13F' has a circumference shorter than that of the lower frame 13F"; that is to say, the working frame 13F tapers off from the bottom to the top (please refer to FIG. 2 simultaneously).

Figure 13:
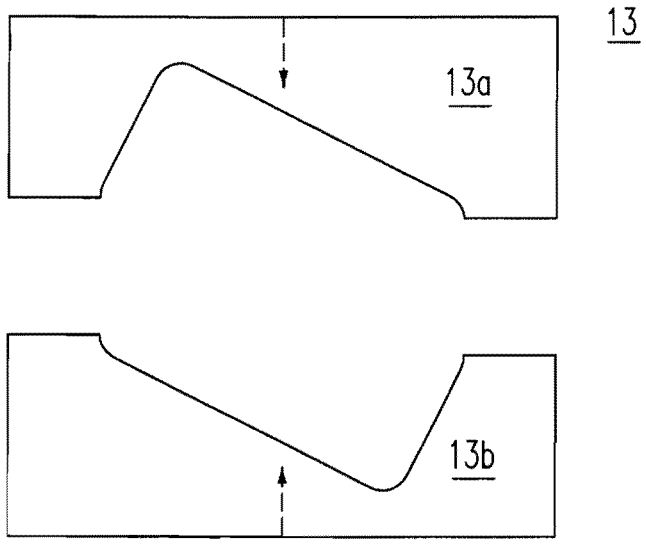
FIGS. 13-14 show the drawing mold according to another preferred embodiment of the present invention.
Figure 14:
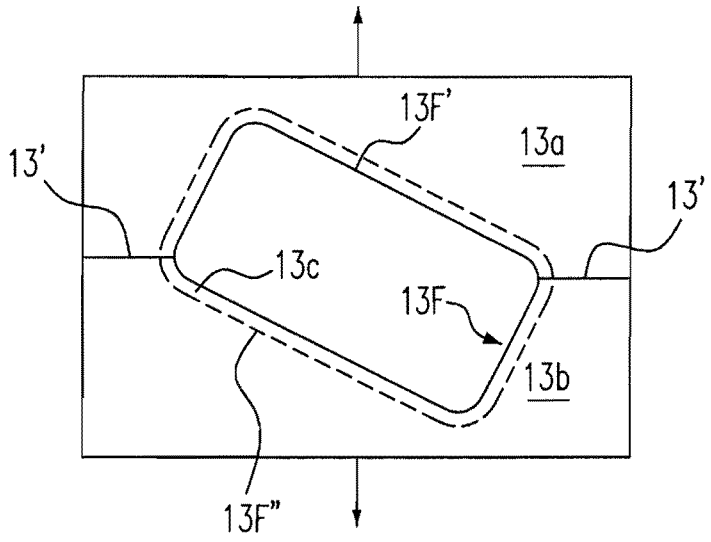

Please refer to FIGS. 13-14, which show the drawing mold according to another preferred embodiment of the present invention. The drawing mold 13 is divided into a left submold 13*a* and a right submold 13*b* (please refer to FIG. 3 simultaneously). The joined state of the drawing mold 13 is shown in FIG. 14, and the split state of the drawing mold 13 is shown in FIG. 13, wherein a working frame 13F is formed in the drawing mold 13. For releasing the case with concave chamfers conveniently, the division of the drawing mold 13 shown in FIG. 14 is achieved by forming the parting lines 13' extending outward from diagonal corners of the working frame 13F. Besides, the working frame 13F further includes an upper frame 13F' and a lower frame 13F". Since FIG. 14 is a top view of the drawing mold 13, the lower frame 13F" is represented by dotted lines, and there are the concave chamfer forming surfaces 13*c* between the upper frame 13F' and the lower frame 13F". The upper frame 13F' has a circumference shorter than that of the lower frame 13F"; that is to say, the working frame 13F tapers off from the bottom to the top (please refer to FIG. 2 simultaneously).

The reason why the drawing mold 13 is used is because of the structure of the concave chamfer. Please refer to FIG. 3. If the drawing mold 13 is not used, and the lower mold 12 and the drawing mold 13 are formed in a unity, the concave chamfer structure of the case B would be wedged in the case forming space S and could not be taken out. This is because the opening of the case forming space S is smaller. In other words, each of the concave chamfer forming surface 13*c* of the drawing mold 13 (please refer to FIG. 2) forms an acute angle with the lower mold 12. Namely, the case forming space S tapers off from the lower mold 12 to the upper mold 11. Specifically speaking, as long as there are lumpy shapes on the lateral of the case forming space S, the case would be unable to release if a mold set joined and split from lateral sides such as the drawing mold 13 is not used.

Based on the above, the present invention provides a mold set for manufacturing a metal case with at least one concave chamfer and a method thereof. Specifically speaking, the present invention further provides a mold set for forming a sharp edge on the concave chamfer structure and a method thereof. The way of combining two mold sets is implemented by manufacturing a metal case with at least one concave chamfer first through a concave chamfer forming mold set, and then forming a sharp edge on the concave chamfer structure through a sharp-edge forming mold set. Otherwise, through the embodiment of FIGS. 8-9, the sharp edge can be formed on the concave chamfer structure via the sharp-edge forming space. Specifically speaking, according to the present invention, not only a metal case with at least one concave chamfer is manufactured, but also a sharp edge is formed on the concave chamfer structure to make the appearance of the metal case more novel and have good texture. The texture of the appearance is an important selling point for many consuming electronic products, so the present invention contributes a lot to the manufacturing method and the mold set of a metal case.

Based on the above, the present invention effectively solves the problems and drawbacks in the prior art, and thus it fits the demand of the industry and is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A mold set for manufacturing a case, comprising:
an upper mold having a fluid channel;
a lower mold facing the upper mold; and
a drawing mold disposed between the upper mold and the lower mold, wherein the mold set has a case forming space formed among the upper mold, the lower mold and the drawing mold, the mold set has a sharp-edge forming space communicating with the case forming space and formed between the drawing mold and the lower mold, the drawing mold has at least one concave chamfer forming surface, and the mold set has an angle formed between the at least one concave chamfer forming surface and the lower mold, and configured in the sharp-edge forming space.

2. A mold set as claimed in claim 1, wherein the lower mold further comprises:
a first lower mold disposed under the case forming space; and
a second lower mold containing the first lower mold, and configured as a guiding structure, wherein when the first lower mold is moved, the second lower mold guides the first lower mold toward the sharp-edge forming space.

3. A mold set as claimed in claim 1, wherein the angle of the mold set is an acute angle.

4. A mold set as claimed in claim 3, wherein the drawing mold further has a working frame located where the drawing mold contacts a periphery of the case forming space.

5. A mold set as claimed in claim 4, wherein the working frame further comprises:
an upper frame under the upper mold; and
a lower frame under the upper frame and above the lower mold, wherein the upper frame has a circumference shorter than that of the lower frame.

6. A mold set as claimed in claim 4, wherein the working frame has a corner, and the drawing mold has a parting line extending outward from the corner of the working frame.

7. A mold set as claimed in claim 6, wherein the drawing mold is divided into a left submold and a right submold by the parting line, and the drawing mold is joined or split by moving at least one of the right submold and the left submold.

8. A mold set as claimed in claim 7, wherein the left submold is fixed to the lower mold, and when the right submold moves relatively to the left submold, the drawing mold is joined or split.

9. A method for manufacturing a case, comprising steps of:
providing a lower mold including a first lower mold and a second lower mold containing the first lower mold;
providing a drawing mold on the lower mold;
operating the drawing mold to form a case forming space between the drawing mold and the lower mold;
placing a blank on the drawing mold;
providing an upper mold;
joining the upper mold and the drawing mold to allow the blank to be disposed between the upper mold and the drawing mold;
deforming the blank into the case forming space; and
moving the first lower mold upward to form a sharp edge on the case.

10. A method as claimed in claim 9, wherein the step of deforming the blank into the case forming space is performed by providing a working fluid flowing through the upper mold to the blank.

11. A method as claimed in claim 9, wherein the working fluid is a liquid.

12. A method as claimed in claim 9, wherein the working fluid is a gas.

13. A method as claimed in claim 12, further comprising a step of:

heating the blank.

* * * * *